US009828706B2

(12) United States Patent
Seawell et al.

(10) Patent No.: US 9,828,706 B2
(45) Date of Patent: Nov. 28, 2017

(54) METHOD OF FORMING CONVERTIBLE TIGHTS

(71) Applicant: HBI Branded Apparel Enterprises, LLC, Winston-Salem, NC (US)

(72) Inventors: Donald R. Seawell, King, NC (US); Ronald W. Brown, Rural Hall, NC (US); Patsy H. Adams, Hamptonville, NC (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 568 days.

(21) Appl. No.: 14/549,245

(22) Filed: Nov. 20, 2014

(65) Prior Publication Data

US 2015/0074872 A1 Mar. 19, 2015

Related U.S. Application Data

(62) Division of application No. 13/361,699, filed on Jan. 30, 2012.

(51) Int. Cl.

| | |
|---|---|
| ***D04B 1/26*** | (2006.01) |
| *D04B 1/24* | (2006.01) |
| *D04B 9/54* | (2006.01) |
| *D04B 9/56* | (2006.01) |

(52) U.S. Cl.

CPC ..... *D04B 1/26* (2013.01); *D04B 1/24* (2013.01); *D04B 9/54* (2013.01); *D04B 9/56* (2013.01)

(58) Field of Classification Search

CPC ... D04B 1/24; D04B 1/26; D04B 9/54; D04B 9/56; D04B 9/46

USPC ..... 66/183–187, 178 A

See application file for complete search history.

(56) References Cited

U.S. PATENT DOCUMENTS

| | | | | |
|---|---|---|---|---|
| 3,111,676 A | | 11/1963 | Artzt | |
| 3,975,929 A | * | 8/1976 | Fregeolle | D04B 1/106 2/239 |
| 4,181,982 A | | 1/1980 | Segovia | |
| 4,475,253 A | | 10/1984 | Laveckis | |
| 4,756,027 A | | 7/1988 | Buenos | |
| 5,054,129 A | * | 10/1991 | Baehr | A41B 11/004 2/239 |
| 5,067,179 A | | 11/1991 | Wormser | |
| 5,097,537 A | | 3/1992 | Ewing | |
| 5,412,957 A | * | 5/1995 | Bradberry | A61F 13/08 2/239 |
| 6,047,571 A | * | 4/2000 | Juniman | A41B 11/08 2/239 |
| 6,415,448 B1 | | 7/2002 | Glogover | |
| 7,533,424 B2 | | 5/2009 | Symonds-Powell | |

(Continued)

*Primary Examiner* — Danny Worrell

(74) *Attorney, Agent, or Firm* — Fish & Richardson P.C.

(57) ABSTRACT

A method of forming an article of hosiery for being worn by a wearer in a footed or footless configuration includes forming a foot portion, leg portion, and panty portion, where the foot portion is formed by turning in an end portion of a circularly knitted fabric tube and connecting a first portion of an end edge to the fabric tube using transfer loops to form a turned welt around only a first portion of the perimeter of the fabric tube. A second portion of the end edge remains unattached and defines an opening between the second portion of the end edge and the fabric tube. The opening is dimensioned to receive toes of the wearer.

19 Claims, 5 Drawing Sheets

(56) References Cited

U.S. PATENT DOCUMENTS

| | | | | |
|---|---|---|---|---|
| 7,669,252 | B2 * | 3/2010 | Wei | A41B 11/08 2/239 |
| D674,589 | S | 1/2013 | Macon | |
| 2002/0083511 | A1 | 7/2002 | Glogover | |
| 2008/0286513 | A1 | 11/2008 | Haigh et al. | |
| 2009/0193567 | A1 | 8/2009 | Treptow et al. | |
| 2010/0282433 | A1 | 11/2010 | Blackford | |
| 2012/0015155 | A1 | 1/2012 | Blackford | |

* cited by examiner

METHOD OF FORMING CONVERTIBLE TIGHTS

CROSS-REFERENCE TO RELATED APPLICATION

This application is a divisional of U.S. patent application Ser. No. 13/361,699, filed Jan. 30, 2012, the contents of which are incorporated herein by reference in its entirety.

FIELD OF THE INVENTION

The present invention relates to the field of women's hosiery, such as stockings or tights, and in particular, to a stocking or tights construction, which may be converted from a footed to a footless configuration, or vice versa.

SUMMARY OF THE INVENTION

The present invention is directed to a women's hosiery construction, which may be easily converted from a footed stocking or tights to a footless hosiery, similar to leggings, wherein the foot portion is turned under when worn in a footless configuration.

In one embodiment, the end portion of a tubular knitted foot portion for an article of hosiery has a turned welt knitted in around about one half of the perimeter of the end portion, leaving about half of the perimeter unattached such that an opening is formed in the end portion, so that the unattached portion of the end portion may be pulled forward and extended over the wearer's toes and sole of the foot, or alternatively wherein the unattached portion may be folded inwardly into the end portion to form a footless configuration.

Another embodiment of the present invention is directed to an article of hosiery, comprising a pair of circularly knitted tubular portions, each tubular portion comprising a panty portion, leg portion, and an integrally knitted foot portion as described above.

Other aspects of the present invention are directed to alternate methods for forming the tubular knitted foot portion and the article of hosiery including the integrally knitted foot portion. In one method, the turned welt is knitted only about one half of the circumference of the end portion, and in an alternate method the turned welt is knitted around the entire circumference, and the unattached portion may be formed by cutting half of the circumference.

Various features and aspects of the invention will become apparent upon review of the detailed description set forth below when taken in conjunction with the accompanying drawings, which are briefly described as follows.

DETAILED DESCRIPTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications, and improvements are within the scope of the present invention.

Figure 1:
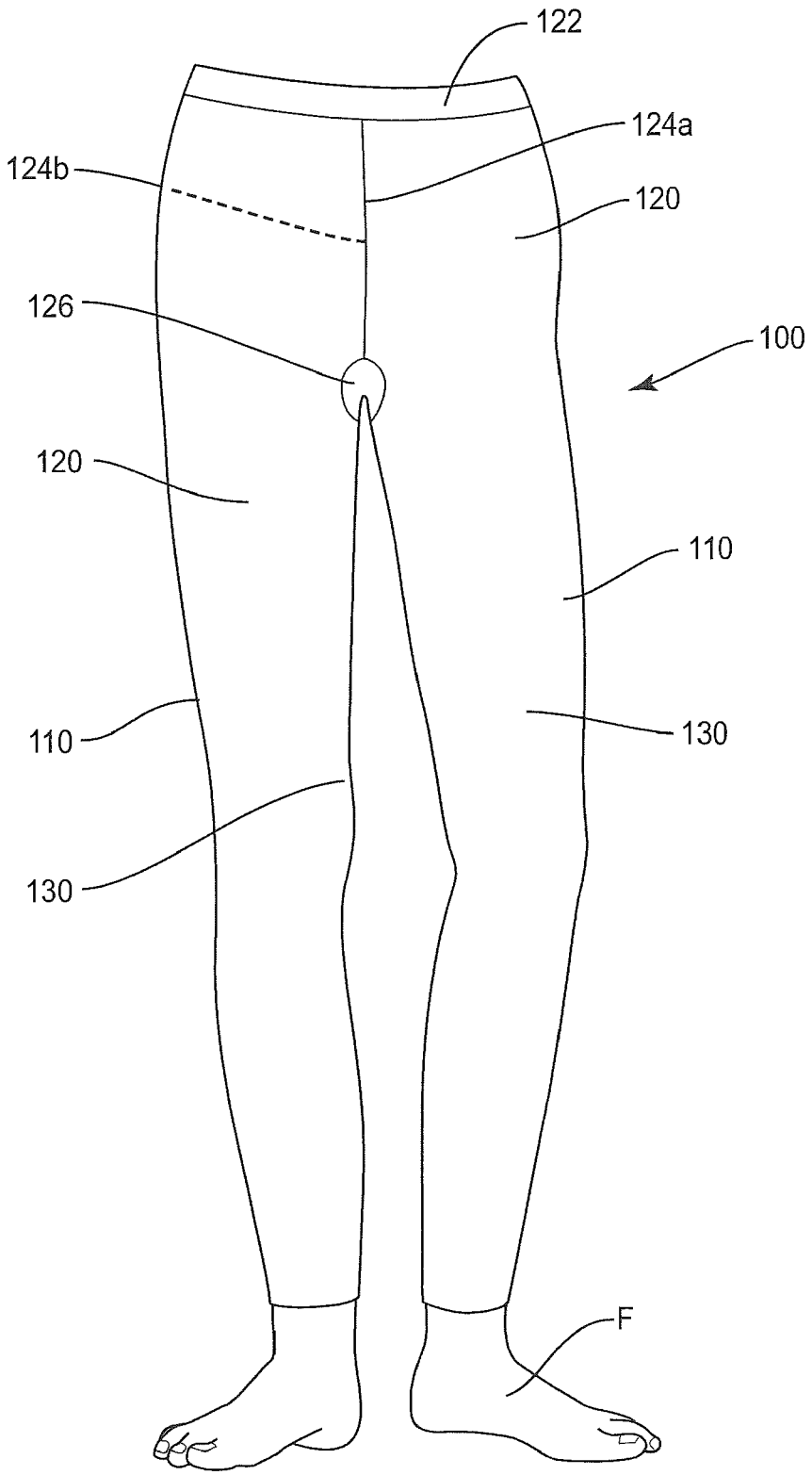
FIG. 1 is a front perspective, environmental view of an embodiment of the convertible tights formed according to the present invention, illustrating the tights when worn in a footless configuration.

Referring to the Figures in general, and to FIG. 1, in particular, the present invention is directed to an article of women's hosiery, shown generally as 100, such as tights. As used herein, "hosiery" refers to any article of apparel that covers some or all of a wearer's legs and/or feet, such as, stockings, tights, socks, etc.

Figure 2:
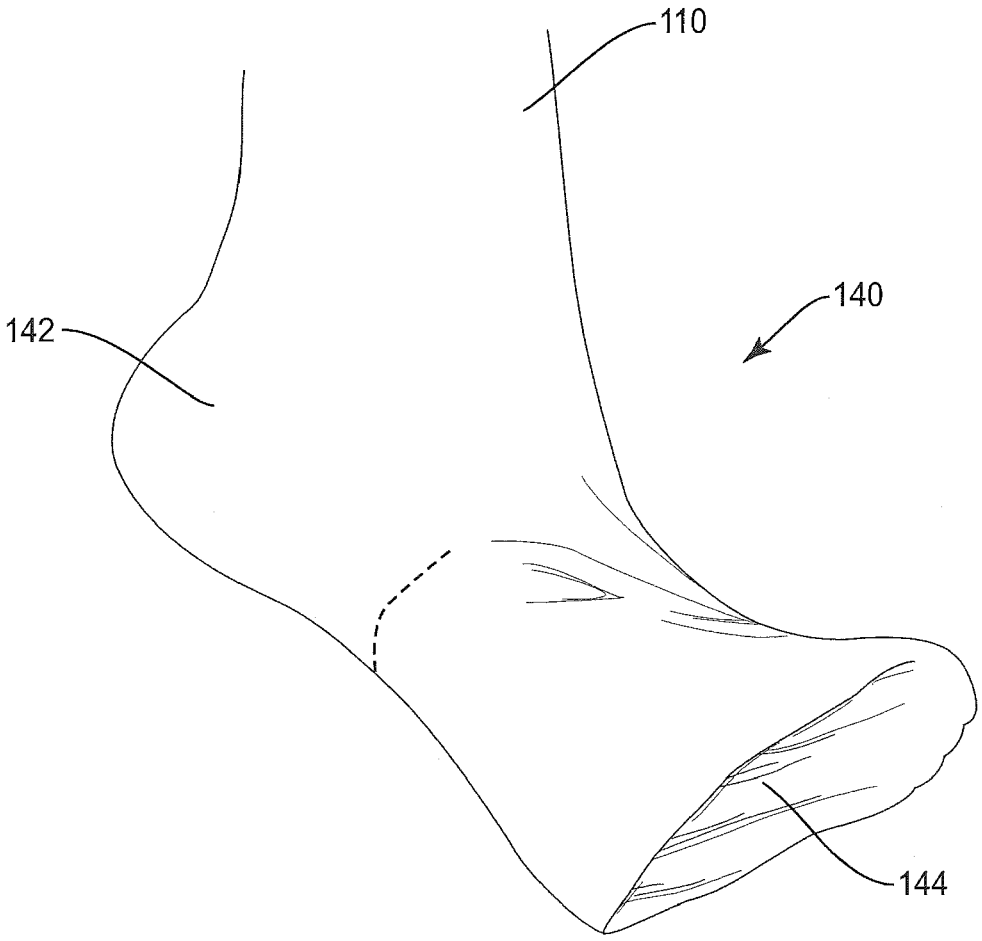
FIG. 2 is a close-up perspective view of the convertible tights of FIG. 1, illustrating the tights when worn in a footed configuration.

As shown in FIG. 1, which is a front perspective, environmental view of an embodiment of the convertible tights formed according to the present invention, illustrating the tights when worn in a footless configuration, the tights 100 comprise a pair of continuously knitted tubes 110, each tube comprising a panty portion 120, a leg portion 130, and an integrally knitted foot portion (shown as 140 in FIG. 2). A waistband 122 may be integrally knitted to the top of the panty portion 120 during the formation of the tubes 110. In forming a complete pair of tights 100, the panty portions 120 may be each cut and seamed together along seams 124*a* and 124*b*. A separately-formed crotch piece 126, formed of similar knitted material, and which may include a liner, may be separately attached to complete the tights. As will be appreciated, the tights may then be dyed a selected color.

Figure 3:
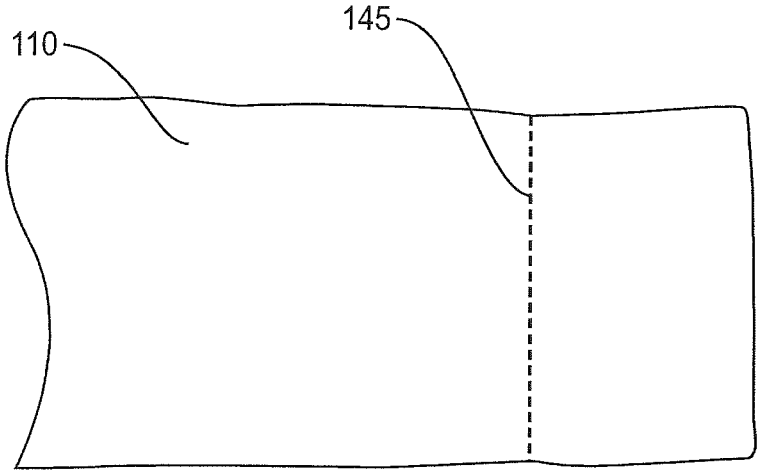
FIG. 3 is a top view of the foot portion of the convertible tights of FIG. 1, illustrating the tights when worn in a footed configuration.

As shown in FIG. 2, which is a close-up perspective view of the convertible tights of FIG. 1, illustrating the tights when worn in a footed configuration, each foot portion 140 comprises an upper portion 142 and an end portion 144, or toe pocket. In one embodiment, as illustrated in FIGS. 2 and 3, during the knitting process, and as explained in greater detail below, the end portion may be turned back inside the tube 110 and the edge adjoined to the outer layer of the tube 110 to complete the turned welt. As explained in greater detail below, this may be done in one of two manners, which include either adjoining the edge of the end portion around approximately one-half of the perimeter of the end portion, or alternatively, by adjoining the edge of the end portion around the entire perimeter of the end portion, and subsequently separating the turned welt around approximately half of the perimeter of the end portion in a manual operation. The turned-in part of the end portion 144, which is in contact with the bottom (sole) of the foot when worn, extends circumferentially around approximately half of the perimeter of the end portion 144.

Referring to FIG. 3, which a top view of the foot portion of the convertible tights of FIG. 1, illustrating the tights when worn in a footed configuration, the turned-in portion of end portion 144 (FIG. 4) may be folded back at or near the line created by a turned welt 145, as that term is commonly known in the knitting arts, where the turned-in portion of a knitted fabric is folded in to create a double layer of fabric and then adjoined along the edge of the end portion with transfer loops, as they are commonly known in the art.

Figure 4:
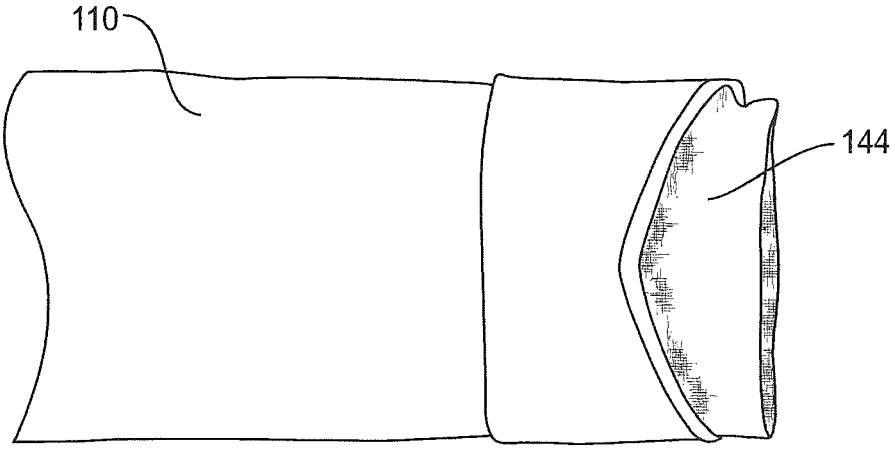
FIG. 4 is a rear view of the convertible tights of FIG. 1, illustrating the tights when worn in a footless configuration.

As shown in FIG. 4, which is a bottom view (when worn) of foot portion 144 (FIG. 3), the turned welt 145 may generally separate the upper portion 142 from the end portion 144.

In an exemplary embodiment, the knitted tubes 110 of tights 100 are formed on a commercially-available Lonati, Model 400 circular knitting machine. This particular knitting machine comprises a standard four inch knitting head having 200 dial jacks, or bits, 400 needles, and 4 yarn feeds; however, other models or brands, including different sizes of knitting heads may be used to form the same tights 100.

The knitting process may begin with the toe pocket 144. One-half, or 100 of the dial jacks on the knitting machine are programmed to knit the end portion 144 to create the turned welt 145. More specifically, the machine is programmed to knit about one half of the end portion 144, hold the fabric so formed, and then complete the turned welt 145 with transfer loops. As will be understood, by knitting with only one half of the dial jacks, the turned welt 145 is completed around approximately half of the perimeter of the end portion 144, with the remaining unattached portion of the perimeter thus forming the toe pocket and a portion of the bottom (sole) part of the foot when worn.

In the embodiment shown in the Figures, three yarns are fed from each of the four yarn feeds, each of the yarns comprising 20 denier spandex plaited with a 40 denier, 34 filament nylon; however, the selection of yarn types, materials, and deniers is not critical to the present invention and may be varied according to the type of hosiery desired. As will be appreciated, tights typically include an elastomeric component.

Alternatively, the circular knitting machine may be programmed to take yarn on all 200 of the dial jacks and complete a turned welt 145 around the entire perimeter of the end portion 144. In this embodiment, the machine is programmed to knit in "puckers" (not shown) approximately 180 degrees apart along the turned welt 145. As used herein, puckers are simply raised portions, or markers. In this embodiment, in a subsequent step, a bar tack is applied manually by an operator over the puckers. A bar tack may be stitched to a fabric to prevent unraveling. In this particular embodiment, subsequent to applying the bar tacks, an operator will manually cut one half of the perimeter along the line 147 forming the turned welt to create the end portion 144.

Figure 5:
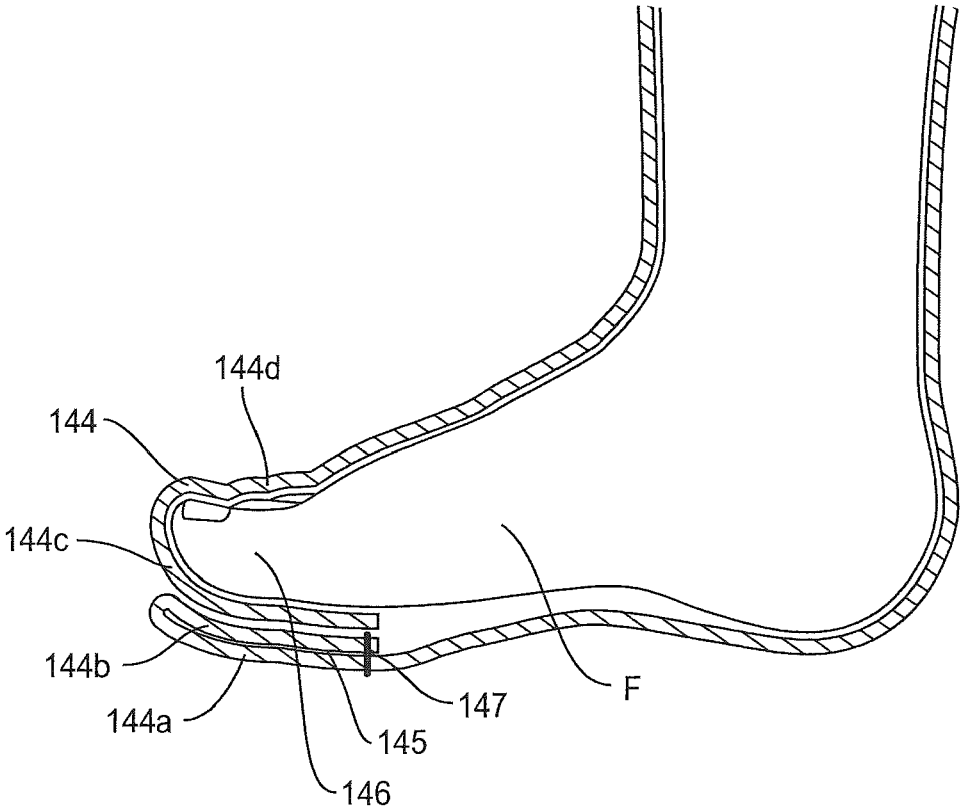
FIG. 5 is a cross-sectional view of the foot portion of the convertible tights of FIG. 3, illustrating the tights when worn in a footed configuration.

Referring now to FIG. 5, a cross-section of the convertible tights 100 in the footed position is illustrated (the scale and thickness of the layers has been exaggerated to better illustrate the configuration of the cross section). To wear the tights in the footed configuration, the wearer's foot 'F' is inserted through the leg opening and is then inserted into the opening 146 of the folded back end portion 144. As shown in FIG. 5, below the wearer's foot F are a first layer 144*a* and a second layer 144*b* of the bottom (sole) side of the end portion 144. The first layer 144*a* and second layer 144*b* are adjoined along line 147. Also, below the wearer's foot F, but above layers 144*a* and 144*b*, is a third layer 144*c*, which forms the folded back portion, or toe pocket 144. Above the wearer's foot F is a top layer 144*d*, which is simply a continuation of third layer 144*c*. As illustrated in FIG. 5, layers 144*c* and layers 144*a* and 144*b*, are unattached.

Figure 6:
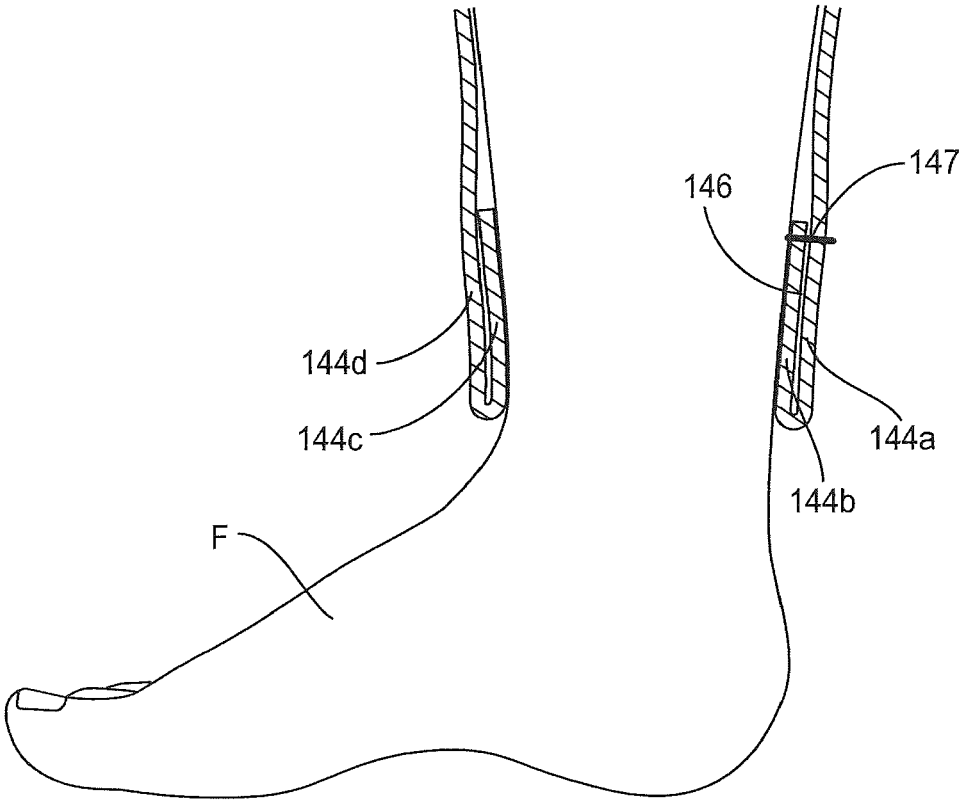
FIG. 6 is a cross-sectional view of the foot portion of the convertible tights of FIG. 4, illustrating the tights when worn in a footless configuration.

Turning lastly to FIG. 6, a cross-section of the convertible tights 100 is illustrated in the footless configuration (again, the scale and thickness of layers has been exaggerated to better illustrate the configuration of the cross-section). To wear the tights in the footless configuration, the wearer's foot F is removed from the opening 146 of end portion 144 and inserted between the first and second layers 144*a* and 144*b*, which are adjoined by the turned welt 145, and the third layer 144*c*, which is folded inwardly beneath top layer 144*d*. Because the first and second layers 144*a* and 144*b* are joined by the turned welt 145, there is no substantially visible seam or bulge when the tights 100 are worn in this footless configuration. As also can be seen in FIG. 6, layers 144*c* and 144*d* are positioned generally in front of the wearer's leg.

With respect to the remaining portions of the convertible tights 100, once the turned welt 145 is formed, the knitting machine is programmed to transfer the yarns from the dial jacks to all 400 needles to knit the leg portion 120 and panty portion 130. Lastly, the yarns are transferred back to the 200 dial jacks, wherein the waistband 122 is also formed having a turned welt 143, as explained above.

Although the present invention has been described with an exemplary embodiment, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A method of forming, on a conventional circular knitting machine of the type having a knitting head with dial jacks and needles, an article of hosiery for being worn by a wearer in a footed or footless configuration, the method comprising:

forming a foot portion of the article of hosiery by circularly knitting with yarns on about one-half of the dial jacks, creating a fabric tube having an end portion and a perimeter, wherein the end portion of the fabric tube includes an end edge of the fabric tube, and turning in the end portion of the fabric tube and connecting a first portion of the end edge to the fabric tube using transfer loops to form a turned welt, wherein the turned welt extends around only a first portion of the perimeter of the fabric tube, so that a second portion of the end edge remains unattached and defines an opening between the second portion of the end edge and the fabric tube; and transferring the yarns to all of the needles to form a leg portion and a panty portion of the article of hosiery, wherein the leg portion is dimensioned to surround a leg of a wearer, the foot portion is dimensioned to receive a foot of the wearer, and the opening is dimensioned to receive toes of the wearer.

2. The method of claim 1, further comprising, after forming the panty portion, transferring the yarns back to all of the dial jacks to create a waistband.

3. The method of claim 2, further comprising cutting the panty portion of a pair of the fabric tubes; and seaming together the pair of fabric tubes along the cut panty portions.

4. The method of claim 3, further comprising separately attaching a crotch piece having a liner.

5. The method of claim 4, further comprising dying the hosiery a selected color.

6. The method of claim 1, wherein the turned welt connected by transfer loops forms substantially no visible exterior seam when the article of hosiery is worn in the footless configuration with the end portion turned in and adjacent to the wearer's skin.

7. A method of forming, on a conventional circular knitting machine of the type having a knitting head with dial jacks and needles, hosiery for being worn by a wearer in a footed or footless configuration, the method comprising:

circularly-knitting with yarns on all of the dial jacks a fabric tube having an end portion and a perimeter;

turning in the end portion of the fabric tube and completing a turned welt around the entire perimeter of the fabric tube with transfer loops to define a foot portion of the hosiery;

transferring the yarns to all of the needles to form a leg portion and a panty portion of the hosiery; and cutting the transfer loops of the turned welt around a portion of the perimeter to create an opening, wherein the leg portion of the hosiery is dimensioned to surround a leg of a wearer, the foot portion of the hosiery is dimensioned to allow a foot of the wearer to extend therethrough, and the opening of the hosiery is dimensioned to accept toes of the wearer.

8. The method of claim 7, further comprising, after completing the panty portion, transferring the yarns back to all of the dial jacks to create a waistband.

9. The method of claim 7, further comprising knitting puckers about 180 degrees apart along the turned welt.

10. The method of claim 9, further comprising applying a bar tack over the puckers to prevent unraveling.

11. The method of claim 7, wherein circularly knitting with yarns comprises knitting with three yarns from each feed of the circular knitting machine.

12. The method of claim 7, wherein the turned welt connected by transfer loops forms substantially no visible exterior seam when the hosiery is worn in the footless configuration with the end portion turned in and adjacent to the wearer's skin.

13. A method of forming hosiery for being worn by a wearer in a footed or footless configuration, the method comprising:

knitting a continuous fabric tube using a circular knitting machine having dial jacks;

turning in an end portion of the fabric tube along a fold line to form a two-ply portion of the tube, the fold line defining a periphery of a first opening; and connecting an edge of the end portion back to the fabric tube with transfer loops to form a turned welt, wherein the edge has a circumference, and only about one-half of the circumference is connected to the fabric tube by the transfer loops and the other one-half of the circumference defines a second opening, the second opening being into a pocket formed between the two-plies of the fabric tube, wherein in the footed configuration, the pocket is for accepting toes of the wearer through the second opening, and in the footless configuration, the first opening is for accepting an ankle of the wearer.

14. The method of claim 13, wherein the hosiery is pantyhose, the fabric tube is a first fabric tube of a pair of fabric tubes, and the pantyhose is further formed by cutting a panty portion of the pair of the fabric tubes, and seaming together the pair of fabric tubes along the cut panty portions.

15. The method of claim 14, further comprising separately attaching a crotch piece having a liner to the panty portion.

16. The method of claim 13, further comprising forming a turned welt at the end of the fabric tube opposite the fold line, wherein the turned welt at least partially defines a waistband.

17. The method of claim 13, wherein knitting comprises knitting with three yarns from each feed of the circular knitting machine.

18. The method of claim 13, wherein the pocket is knit with about one-half of the dial jacks available on the knitting machine.

19. The method of claim 13, wherein the turned welt connected by transfer loops forms substantially no visible exterior seam when the hosiery is worn in the footless configuration with the end portion turned in and configured to be adjacent the wearer's skin.

* * * * *